United States Patent [19]

Wolf

[11] Patent Number: 4,741,717

[45] Date of Patent: May 3, 1988

[54] SMOKE GENERATOR FOR PASSIVE TOY

[76] Inventor: Tobin Wolf, 1610 Harmon Cove Towers, Secaucus, N.J. 07094

[21] Appl. No.: 820,807

[22] Filed: Jan. 22, 1986

[51] Int. Cl.[4] ..... A63H 33/28; A63H 33/26; A63J 3/00

[52] U.S. Cl. ..... 446/24; 446/485; 272/8 F; 272/8 R

[58] Field of Search ..... 446/24, 25, 485; 40/407; 272/8 R, 8 F, 15

[56] References Cited

U.S. PATENT DOCUMENTS

| | | | |
|---|---|---|---|
| Re. 26,563 | 4/1969 | Seuthe | 446/25 |
| 2,061,471 | 11/1936 | Larson | 446/24 X |
| 2,324,359 | 7/1943 | Callan | 446/24 |
| 2,561,849 | 7/1951 | Everett | 446/24 |
| 2,610,437 | 9/1952 | Smith | 446/25 |
| 2,628,450 | 2/1953 | Shelton | 446/24 |
| 2,855,714 | 10/1958 | Thomas | 446/24 |
| 3,154,881 | 11/1964 | Elwell | 446/24 |
| 3,178,850 | 4/1965 | Brown | 446/25 |
| 3,537,709 | 11/1970 | O'Connell | 446/24 X |
| 4,104,741 | 8/1978 | Shaw et al. | 272/8 F |
| 4,332,101 | 1/1982 | Tomita | 446/24 |

FOREIGN PATENT DOCUMENTS

| | | | |
|---|---|---|---|
| 696852 | 10/1964 | Canada | 446/25 |
| 705351 | 3/1941 | Fed. Rep. of Germany | 446/24 |
| 686172 | 1/1953 | United Kingdom | 446/25 |

*Primary Examiner*—Robert A. Hafer
*Assistant Examiner*—D. Neal Muir
*Attorney, Agent, or Firm*—Jay M. Cantor

[57] ABSTRACT

The disclosure relates to a smoke generator for a toy, primarily passive toys, which the blower for blowing smoke out of the smoke generating chamber operates intermittently and mechanically, simultaneously with the generation of the smoke, so that the operation of the battery used for smoke generation is also intermittent, thereby prolonging battery life. Also disclosed is a smoke generator wherein a metal film or carbon resistor is utilized to heat an oil containing wick to produce the smoke.

4 Claims, 2 Drawing Sheets

SMOKE GENERATOR FOR PASSIVE TOY

BACKGROUND OF THE INVENTION

1. Field of the Invention

This invention relates to a smoke generator and, more specifically, to a smoke generator for use in conjunction with passive devices, especially for toys and the like.

2. Brief Description of the Prior Art

Smoke generators, especially for use in conjunction with toys, are well known in the art. Such smoke generators have generally been used in conjunction with motorized toys having a source of power, such as batteries or house current. Examples of such toy are electric trains or the like.

In the operation of typical prior art smoke generating devices, a heated filament in contact with an oil soaked wick generated a wisp of smoke which was then blown out of the smoke generating chamber by a stream of air. The air stream was generally provided by a blowing mechanism which derived its power from an external power source, such as a battery or house current used to drive a motor, rotating wheels or the like. Unfortunately, such sources of power are not generally available in passive toys, such as passive dolls. Furthermore, unlike the case of electric trains, a smoke generator for a doll, if powered, would require battery operation. The problem of battery drain is therefore also introduced where a battery is to be used to provide both the smoke and the blowing action to drive the smoke from the smoke generating chamber.

SUMMARY OF THE INVENTION

In accordance with the present invention, the above noted problems of the prior art are minimized and there is provided a smoke generator for use in conjunction with passive toys which is of simple construction and is yet able to produce both smoke and the blowing action of the prior art without excessive battery requirements.

Briefly, in accordance with the present invention, there is provided, according to a first embodiment thereof, a passive toy having a weapon that discharges smoke. Contained within the weapon is an oil soaked wick disposed in a compartment and a heat generating wire, around which a portion of the wick is wound to generate the smoke. A battery pack is affixed to the rear of the toy and contains a battery circuit controlled by a switch for intermittently powering the wire. Also contained in the battery pack is a hand operated piston which blows air through the compartment to cause the generated smoke to pass through and out of the weapon barrel. In this way, the battery is used only upon switch operation in an intermittent manner to provide smoke with the air blowing function being provided mechanically without battery power.

In accordance with a second embodiment of the invention, the entire smoke producing mechanism is placed within the toy interior including the batteries if the toy interior is sufficiently large and externally if the toy interior is not sufficiently large. The toy is shown as a doll with smoke designed to emanate from the mouth thereof. The toy includes the same oil containing wick and heated wire arrangement as in the first embodiment with the switch mechanism for the battery also serving to provide the blowing action of the air through the smoke compartment whereby a single operation of a push button switch provides the heating and blowing functions simultaneously, again with only intermittent use of battery power. The head of the toy communicates with the smoke chamber and is on a swivel to permit head rotation with concommitant ability to emit smoke.

In accordance with a further feature of the invention, the smoke generator may include a carbon or metal film resistor of from about 2 to about 4 ohms with a 3 volt battery thereacross to form a heating element. The oil soaked wick is wound around the solid resistor to produce the smoke.

In the case of relatively small 6 or 7 inch action dolls, the batteries are physically constrained to two AA cells. In this instance, the AA cells may have insufficient life notwithstanding the intermittent operation. However, if the size of the toy permits, two C or two D cells have more than sufficient capacity and, in use approximating the attention span and play habits of children, do yield several hundred operations. Accordingly, the smoke generator using this type of solid resistor affords superior economic and manufacturing advantages over prior art smoke generators as described hereafter.

DESCRIPTION OF THE PREFERRED EMBODIMENT

Figure 2:
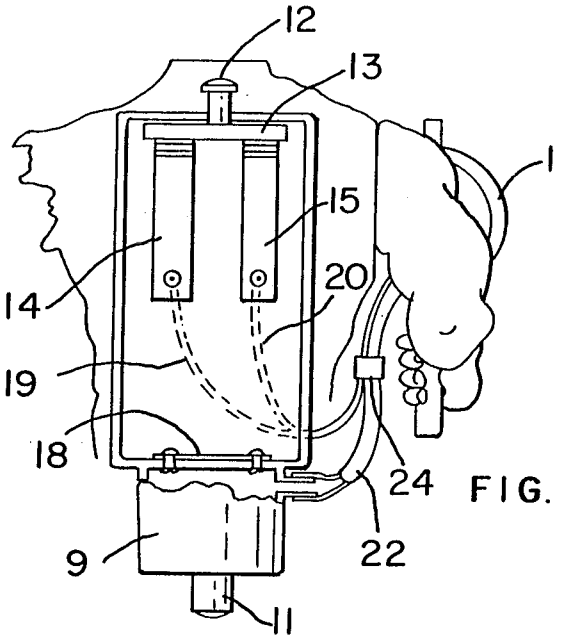
FIG. 2 is a cross-sectional rear view of the back pack of FIG. 1.
Figure 1:
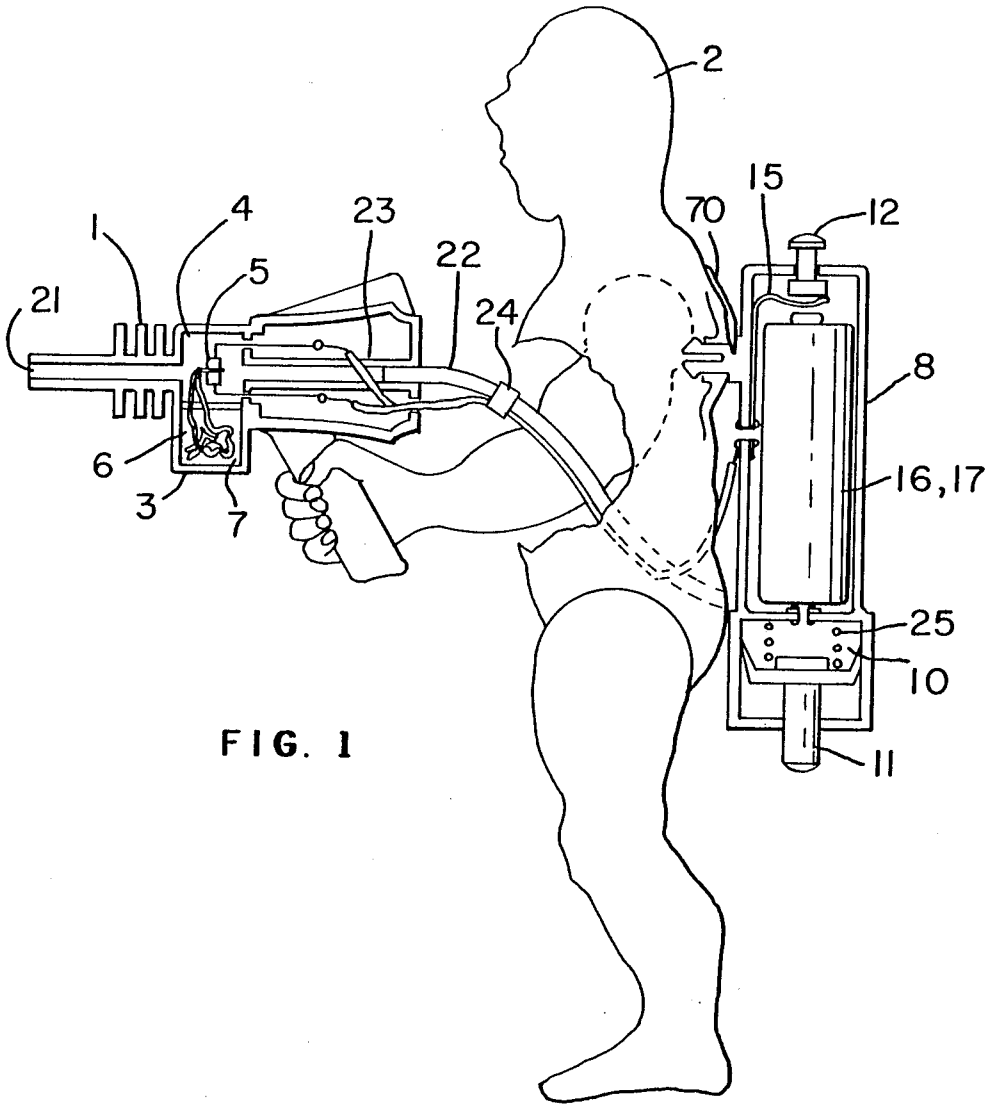
FIG. 1 is a cross-sectional side view of a smoke generator coupled to a passive toy in accordance with a first embodiment of the present invention.

Referring first to FIGS. 1 and 2, there is shown a first embodiment of the present invention. There is shown a doll 2 holding a futuristic weapon 1 in the form of a gun in its hand. The interior of the weapon 1 includes a smoke generator within the weapon housing 3 which includes a smoke chamber 4 containing a heating coil in the form of a high resistance wire 5 therein. An oil soaked wick 6 is disposed in a compartment 7 of the housing 3, an end of the wick being wrapped around the coil or wire 5 whereby, when the coil is sufficiently hot, it causes the oil in the wick in contact therewith to smoke. As oil at the coil is decomposed pyrolitically, the wicking action causes other oil in the wick and/or compartment 7 to travel to the coil for further decomposition thereof when the coil is sufficiently hot.

The coil 5 is heated by current provided from a battery disposed in a battery pack 8 which is snapped onto the back of the doll 2 by means of snaps 70, only one of which is shown in FIG. 1. The snaps 70 are composed of a pair of resilient fingers 71, integral with the pack 8, which bend toward each other due to the camming action on the snaps, whereby the snaps enter and are locked in the interior of the doll. Affixed to the bottom of the battery pack 8 is a pump 9 which comprises a cylinder 10 and a piston 11 biased out of the pack by a spring 25. At the opposite end of the battery pack 8 is a push button switch 12 having a bar 13 affixed thereto which, when depressed, lowers the battery contacts 14 and 15 to simultaneously touch both of the upper terminals of the batteries 16 and 17. This completes a circuit with the lower battery contact 18 and the electric wires 19 and 20 which extend from the battery pack to the heating coil 5.

In operation, both push button 12 and piston 11 are operated simultaneously, for example, by placing the thumb of the right hand on the piston 11 and the index finger on the push button 12. By compressing both push button 12 and piston 11 simultaneously, electrical contact is made to close the electrical circuit to the coil as the air in the cylinder 10 is discharged. Since the outward bias on the push button 12 requires less pressure and operates over a shorter distance than the piston 11, the heater coil 5 is energized at the start of the piston stroke. The smoke generated in the smoke chamber 4 ahead of the air stream generated by the cylinder is then blown out of the gun barrel 21 by the compressed air delivered from the piston 11 and cylinder 10 via the flexible tube 22 to the nozzle 23 of the weapon 1. The wires 19 and 20 and the flexible tube 22 may be bound together at intervals by bands 24 as shown. The compression spring 25 returns the piston to its original position and the resiliency of contacts 14 and 15 returns the push button 12 to the open switch position as shown in FIG. 1. It is therefore apparent that the blowing action requires no battery power and the smoke generation requires only intermittent battery operation. The pump 9 consisting of the cylinder 10 and the piston 11 may be replaced by a bellows.

Figures 3, 4, 5:
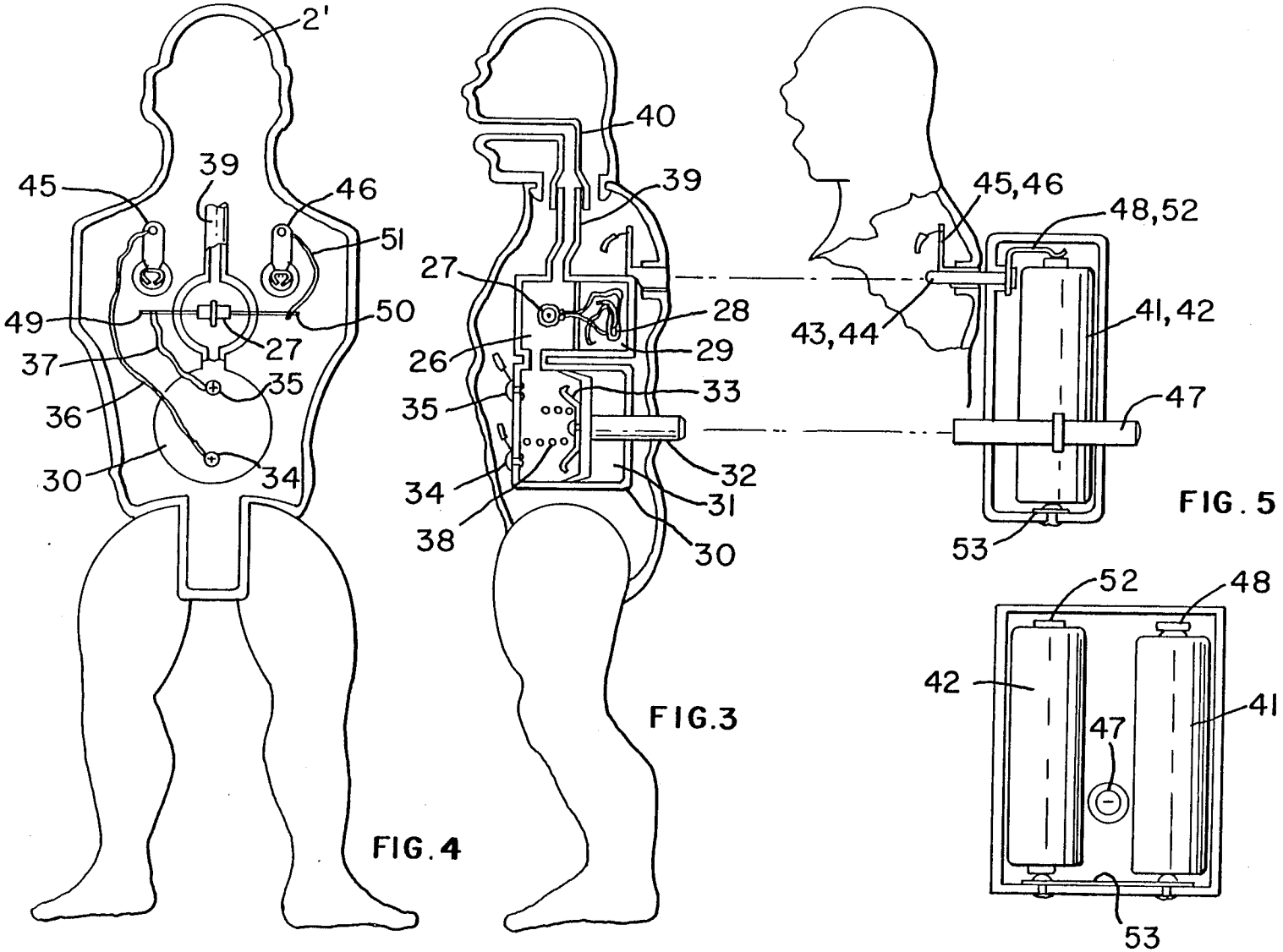
FIG. 3 is a cross-sectional side view of a smoke generator coupled to a passive toy in accordance with a second embodiment of the invention.
FIG. 4 is a cut away front view of the interior of the embodiment of FIG. 3, FIGS. 5(*a*) and 5(*b*) are cross-sectional side and rear views respectively of an external battery pack for FIG. 3, FIG. 6(*a*) is a prior art heating coil for use in conjunction with smoke generators.

Referring now to FIGS. 3 and 4, there is shown a second embodiment of the invention which is depicted in accordance with a monster figure wherein the smoke is designed to emanate from the mouth, for example, of the monster. In this embodiment the smoke generator is entirely incorporated within the body 2' with the battery pack being external thereto only if the body is too small to contain it. The smoke generator comprises a smoke chamber 26 having a heating coil 27 therein and a long oil soaked wick 28 confined in compartment 29 with a portion of the wick wrapped around the coil 27. The pump 30 comprises a cylinder 31 and a piston 32, the pump incorporating therein the electrical switch which allows the coil 27 to be heated by the current flowing thereto from the battery (not shown). The switch comprises a contact 33 affixed to the piston in any well known manner and two electrical contacts 34 and 35. The compression spring 38 returns the piston and switch to their original position.

The tube 39 emanating from the smoke chamber 26 is centrally located in the neck and rotatably connected to the tube 40 leading to the doll's mouth. In this manner, the doll's head can be rotated while maintaining the exhaust path for the smoke.

The batteries 41 and 42 for the embodiment of FIGS. 3 and 4 are shown in FIGS. 5(*a*) and 5(*b*) in a battery pack 8' fastened to the back of the doll by means of the contact pins 43 and 44 that fit snugly into the pin sockets 45 and 46 and serve both to fasten the battery pack to the doll and conduct electricity to pin sockets 45 and 46. The pin 47, slidably mounted within the battery pack, serves to operate the piston 32 while keeping the length of the piston rod that extends from the doll body to a minimum.

The current path is apparent and is traced from the positive contact 48 of the battery 41 through the pin 43 and socket 45 through the wire 36 to the rivet contact 34, across the moving contact 33 to the rivet contact 35, then through the wire 37 to the heating coil lead 49 and then through the heating coil 27 to the coil lead 50 and then through the wire 51 to the socket 46 and pin 44 to the negative contact 52 of the battery 42, the batteries 41 and 42 being connected by the contact strip 53.

It is apparent that the switch contained within the cylinder as shown in FIG. 3 may also be incorporated into the cylinder shown in FIG. 1, thus eliminating the separate push button switch. The need to actuate the piston repetitively to obtain the air stream in order to pump the smoke out of the generator is advantageous because it causes the intermittent operation of the switch and thereby limits the drain on the batteries.

Figure 6:
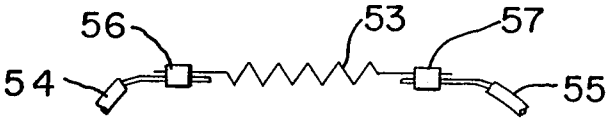
FIG. 6(*b*) is novel heating means for a smoke generator in accordance with the present invention.
Figure 6:
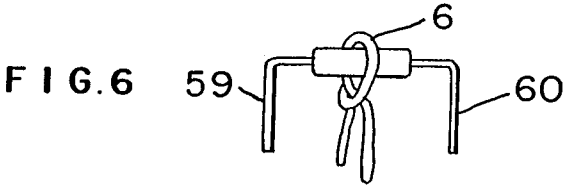

As stated hereinabove, smoke generators have traditionally utilized a coil of very fine high resistance wire of the type normally used in a light bulb as shown in FIG. 6(*a*). The handling and mounting of such a delicate heating element comprising a coil 53 and means to fasten leads 54 and 55 to the coil such as the crimped fasteners 56 and 57 are not desirable. The problem is compounded when the wick must be placed securely in contact with the coil. Accordingly, it has been determined that solid resistors 58 as shown in FIG. 6(*b*), such as carbon or metal film resistors, can be used in this unusual manner as heaters and have the advantage of attached leads 59 and 60. These solid resistors are particularly advantageous when tying or wrapping the wick 61 around the body of the resistor as shown in FIG. 6(*b*). As stated above, smoke generators utilizing heaters of the type described in FIG. 6(*b*) can perform several hundred smoke generating operations when operated intermittently in the manner described hereinabove. Resistor values of approximately 2 to 4 ohms operating with a battery source of two C or D cells are satisfactory and afford the advantages stated above.

Though the invention has been shown with respect to specific preferred embodiments thereof, many variations and modifications will immediately become apparent to those skilled in the art. It is therefore the intention that the appended claims be interpreted as broadly as possible in view of the prior art to include all such variations and modifications.

What is claimed is:

1. A smoke generator, which comprises:

(a) a compartment having a gas ingress and a gas egress, (b) smoke generating means comprising an electrical resistance means and smoke generating material means in close contact with said electrical resistance means disposed in said compartment, and an electrical energy source means (c) control means controlling operation of blowing air into said ingress to cause smoke existing in said compartment to exit said compartment through said egress, said control means then actuating said smoke generating means, wherein said control means comprises a normally open switch electrically connected to said electrical energy source and said electrical resistance means, a movable member for closing said switch in response to predetermined movement of said movable member to cause said smoke generating means to generate smoke, said movable member being in the shape of a piston, said smoke generator further including a piston housing containing said movable member and a passage communicating between said piston housing and said compartment ingress to drive air from said piston housing, when said movable member is moved to close said switch, through said passage, to said ingress, to force smoke existing in said compartment out of said egress.

2. A smoke generator as set forth in claim 1 wherein said smoke generating means is a heating element having a wick containing a fluid therein communicating therewith, said heating element being energized by said control means closing said switch.

3. A smoke generator as set forth in claim 1, further including a spring bias to normally bias said movable means to maintain said switch open.

4. A smoke generator as set forth in claim 2, further including a spring bias to normally bias said movable means to maintain said switch open.

* * * * *